US006177045B1

(12) United States Patent
Ecob et al.

(10) Patent No.: US 6,177,045 B1
(45) Date of Patent: Jan. 23, 2001

(54) COMPOSITION AND METHOD FOR INOCULATING LOW SULPHUR GREY IRON

(75) Inventors: Christopher Ecob, Burntwood (GB); Douglas White, Mentor, OH (US); David Butler, Litchfield (GB)

(73) Assignee: Elkem ASA (NO)

( * ) Notice: Under 35 U.S.C. 154(b), the term of this patent shall be extended for 0 days.

(21) Appl. No.: 09/101,294

(22) PCT Filed: Jan. 10, 1997

(86) PCT No.: PCT/GB97/00073

§ 371 Date: Aug. 20, 1998

§ 102(e) Date: Aug. 20, 1998

(87) PCT Pub. No.: WO97/26376

PCT Pub. Date: Jul. 24, 1997

(30) Foreign Application Priority Data

Jan. 16, 1996 (GB) ..... 9600807

(51) Int. Cl.[7] ..... C22C 38/02; C22C 30/00

(52) U.S. Cl. ..... 420/83; 420/578; 420/29; 420/30

(58) Field of Search ..... 420/578, 82, 29, 420/30; 75/507, 246

(56) References Cited

U.S. PATENT DOCUMENTS

| | | | |
|---|---|---|---|
| 4,224,064 | | 9/1980 | Bilek . |
| 4,581,203 | | 4/1986 | Bruckmann . |

FOREIGN PATENT DOCUMENTS

| | | | | |
|---|---|---|---|---|
| 38 09 315 | | 10/1989 | (DE) . | |
| 0 357 521 | | 3/1990 | (EP) . | |
| 1 179 083 | | 1/1970 | (GB) . | |
| 468962 | * | 4/1975 | (RU) | 420/578 |
| 0837984 | * | 6/1981 | (RU) | 420/578 |

* cited by examiner

*Primary Examiner*—Deborah Yee

(57) ABSTRACT

A composition for inoculating grey iron, particularly low sulphur grey iron, comprises by weight: rare earth 1.0–4.0%, preferably 1.5–2.5%; strontium 0.5–1.5%, preferably 0.7–1.0%; calcium 1.5% maximum, preferably 0.5% maximum; aluminum 2.0% maximum, preferably 0.5% maximum; silicon 40.0–80.0%, preferably 70.0–75.0%; iron balance. The composition is most preferably free of calcium and aluminum. The rare earth may be cerium, mischmetall or a mixture of cerium and other rare earths. The composition may be a mixture of ferrosilicon and the other constituents, a ferrosilicon alloy containing the other constituents or a rare earth and a silicon-bearing inoculant containing strontium.

18 Claims, No Drawings

COMPOSITION AND METHOD FOR INOCULATING LOW SULPHUR GREY IRON

This invention relates to a composition for inoculating grey iron and more particularly to a composition for the inoculation of a grey iron having a low sulphur content.

Inoculation is a process for controlling the solidification behaviour of the austenite/graphite eutectic and suppressing the formation of the austenite/carbide eutectic in grey cast irons. The inoculation treatment ensures that the cast iron has a fully grey structure, provided it is done just prior to casting of the iron, and produces benefits such as improved mechanical properties and machineability. A variety of inoculants have been used and many of those are based on ferrosilicon alloys. Other commonly used inoculants are alloys or mixtures of such elements as calcium, silicon, graphite, barium, strontium, aluminum, zirconium, cerium, magnesium, manganese and titanium.

Most inoculants, although effective in inoculating molten irons having a sulphur content of above 0.04% by weight, are unsatisfactory as inoculants for low sulphur irons having a sulphur content of 0.04% by weight or below.

In order to improve the response of low sulphur irons to inoculation, it has been proposed to add iron sulphide to the molten iron in order to increase the sulphur content. However, this procedure is only partially effective and can produce undesirable side effects.

GB-A-2093071 describes a method for inoculating molten iron involving the use of a source of sulphur and a reactant which forms a sulphide therewith which sulphide is capable of acting to provide nuclei in the form of graphite from the molten iron. The source of sulphur may be sulphur itself or a sulphide mineral such as chalcocite, bornite, chalcopyrite, stannite, iron sulphide or covellite. The sulphide forming reactant may be calcium silicide, calcium carbide, a cerium or strontium alloy, a rare earth and/or magnesium.

It has now been found that a ferrosilicon based composition containing rare earths and strontium can be used effectively as an inoculant for low sulphur iron, without the need to increase the sulphur content of the iron during the inoculation treatment, if the amount of each element is controlled within a certain range and the content of any calcium and/or aluminum which is present does not exceed a certain amount.

According to the invention, there is provided a composition for inoculating molten grey iron comprising by weight:

| | |
|---|---|
| Rare earth | 1.0–4.0% |
| Strontium | 0.5–1.5% |
| Calcium | 1.5% maximum |
| Aluminium | 2.0% maximum |
| Silicon | 40.0–80.0% |
| Iron | balance |

Preferably the composition comprises by weight:

| | |
|---|---|
| Rare earth | 1.5–2.5% |
| Strontium | 0.7–1.0% |
| Calcium | 0.5% maximum |
| Aluminium | 0.5% maximum |

-continued

| | |
|---|---|
| Silicon | 70.0–75.0% |
| Iron | balance |

The rare earth may be cerium, mischmetall containing nominally 50% by weight cerium and 50% by weight other rare earths or a mixture of cerium and other rare earths.

The inoculant composition is most preferably free of aluminum and calcium but if these elements are present the amounts should not exceed the limits indicated. Aluminum is, in general, considered to be a harmful constituent in inoculant compositions, and calcium has an adverse reaction with strontium and affects its performance.

The inoculant composition may be a particulate mixture of ferrosilicon and the other constituents of the composition but it is preferably a ferrosilicon based alloy containing the other constituents.

The inoculant can be made in any conventional manner with conventional raw materials. Generally, a molten bath of ferrosilicon is formed to which a strontium metal or strontium silicide is added along with a rare earth.

Preferably, a submerged arc furnace is used to produce a molten bath of ferrosilicon. The calcium content of this bath is conventionally adjusted to drop the calcium content to below the 0.35% level. To this is added strontium metal or strontium silicide and a rare earth. The additions of the strontium metal or strontium suicide and rare earth to the melt are accomplished in any conventional manner. The melt is then cast and solidified in a conventional manner.

The solid inoculant is then crushed in a conventional manner to facilitate its addition to the cast iron melt. The size of the crushed inoculant will be determined by the method of inoculation, for example, inoculant crushed for use in ladle inoculation is larger than the inoculant crushed for use in mould inoculation. Acceptable results for ladle inoculation are found when the solid inoculant is crushed to a size of about 1 cm down.

An alternative way to make the inoculant is to layer into a reaction vessel a charge of silicon and iron or ferrosilicon, strontium metal or strontium silicide and rare earth and then melt the charge to form a molten bath. The molten bath is then solidified and crushed as described above.

When the inoculant is made from a base alloy of ferrosilicon, the silicon content of the inoculant is about 40 to 80% and the remaining per cent or balance after taking into account all other specified elements is iron.

Calcium will normally be present in the quartz, ferrosilicon and other additives such that the calcium content of the molten alloy will generally be greater than about 0.5%. Consequently, the calcium content of the alloy will have to be adjusted down so that the inoculant will have a calcium content within the specified range. This adjustment is done in a conventional manner.

The aluminum in the final alloy is also introduced into the alloy as an impurity in the various additives. If desired, it can also be added from any other conventional source of aluminum or aluminum can be refined out of the alloy using conventional techniques.

The exact chemical form or structure of the strontium in the inoculant is not precisely known. It is believed that the strontium is present in the inoculant in the form of strontium silicicle ($SrSi_2$) when the inoculant is made from a molten bath of the various constituents. However, it is believed that any metallic crystallographic form of the strontium is acceptable in the inoculant.

Strontium metal is not easily extracted from its principal ores, Strontianite, strontium carbonate, ($SrCO_3$) and Celesite, strontium sulphate ($SrSO_4$). However, the inoculant may be produced with either strontium metal or strontium ore depending upon the economics of the entire production process.

U.S. Pat. No. 3333954 discloses a convenient method for making a silicon bearing inoculant containing acceptable forms of strontium wherein the source of strontium is strontium carbonate or strontium sulphate.

The carbonate and sulphate are added to a molten bath of ferrosilicon. The addition of the sulphate is accomplished by the further addition of a flux. A carbonate of an alkali metal, sodium hydroxide and borax are disclosed as appropriate fluxes. The method of the 3333954 patent encompasses adding a strontium-rich material to a molten ferrosilicon low in calcium and aluminum contaminates at a sufficient temperature and for a sufficient period of time to cause the desired amount of strontium to enter the ferrosilicon. U.S. Pat. No. 3,333,954 is incorporated herein by reference and discloses a suitable way to prepare a silicon-bearing inoculant containing strontium to which a rare earth can be added to form the inoculant of the present invention. The addition of the rare earth is preferably done after the addition of the strontium, however, the sequence of the addition is not critical so long as the inoculant has the proper amounts of reactive elements. The addition of the rare earth is accomplished in any conventional manner.

The rare earth can come from any conventional source, for example, individual pure rare earth metals, mischmetall, rare earth of cerium silicide and, under appropriate reducing conditions, rare earth ores such as bastnasite or manazite.

There are the normal amount of trace elements or residual impurities in the finished inoculant. It is preferred that the amount of residual impurities be kept low in the inoculant.

It is preferred that the inoculant be formed from a molten mixture of the different constituents as described hereinbefore, however, the inoculant of the present invention can be made by forming a dry mix or briquette that includes all of the constituents without forming a molten mix of the constituents.

It is also possible to use two or three of the constituents in an alloy and then add the other constituents, either in a dry form or as briquettes, to the molten iron bath to be treated. Thus, it is within the scope of this invention to form a silicon-bearing inoculant containing strontium and use it with a rare earth.

The addition of the inoculant to the cast iron is accomplished in any conventional manner. Preferably, the inoculant is added as close to final casting as possible. Typically, ladle and stream inoculation are used to obtain very good results. Mould inoculation may also be used. Stream inoculation is the addition of the inoculant to a molten stream as it is going into the mould.

The amount of inoculant to add will vary and conventional procedures can be used to determine the amount of inoculant to add. Acceptable results can be obtained by adding about 0.05 to 0.3% of inoculant based on the weight of iron treated when using ladle inoculation.

The following examples will serve to illustrate the invention:

EXAMPLE 1

An inoculant composition, according to the invention, was produced in the form of a ferrosilicon based alloy comprising by weight:

| | |
|---|---|
| Rare earth | 2.25% |
| (Cerium | 1.50%) |
| Strontium | 0.90% |
| Calcium | 0.15% |
| Aluminium | 0.37% |
| Silicon | 73.2% |
| Iron | balance |

This composition was tested as an inoculant for low sulphur iron in comparison with two commercially available inoculants, FOUNDRISIL® and CALBALLOY™ and with a ferrosilicon based alloy containing 2.0% by weight rare earth (1.2% by weight cerium) and 1.0% by weight calcium but no strontium.

Each of the inoculants was used to inoculate three irons containing three different levels of sulphur, 0.01%, 0.03% and 0.05% by weight.

In each test the molten iron was treated with the inoculant composition at 1420° C. just prior to casting and from each inoculated iron chill plate castings, chill wedge castings and bar castings were produced.

Similar castings were also produced from each of the three irons prior to inoculation.

The amounts by weight of inoculant composition used based on the weight of iron and the results obtained are shown in Table 1.

In the Table, "RE/Sr" denotes the inoculant composition according to the invention and "RE/Ca" denotes the ferrosilicon alloy containing rare earth and calcium but no strontium.

The graphite morphology was determined by classifying the form and size of the graphite in a polished microspecimen taken from the centre of the bar casting. This was done by comparing the specimen at a standard magnification of 100 diameters with a series of standard diagrams, and allocating letters and numerals to indicate form and size of the graphite based on the system proposed by the American Society for the Testing of Metals, ASTM Specification A247.

TABLE 1

| INOCULANT | Sulphur Content of Iron (%) by weight | Chill Plates (depth in mm) 3 mm | 6 mm | 9 mm | Wedge (width in mm) | Eutectic Cell Count 24 mm bar No/cm$^2$ | Graphite Morphology 24 mm bar (centre) |
|---|---|---|---|---|---|---|---|
| Uninoculated | 0.01 | white | white | white + mottle | white + mottle | 60 | D + E |
| 0.1% FOUNDRISIL | 0.01 | 10 | 4 | Grey | 4 | 410 | A4 + some A5/D |

TABLE 1-continued

| INOCULANT | Sulphur Content of Iron (%) by weight | Chill Plates (depth in mm) 3 mm | 6 mm | 9 mm | Wedge (width in mm) | Eutectic Cell Count 24 mm bar No/cm$^2$ | Graphite Morphology 24 mm bar (centre) |
|---|---|---|---|---|---|---|---|
| 0.07% RE/Ca | 0.01 | white + mottle | 9 | 2 mottle | 6 | 175 | A4 + trace D |
| 0.15% RE/Ca | 0.01 | 1 | Grey | Grey | Grey | 300 | A4 + some A5 |
| 0.07% RE/Sr | 0.01 | 2 | Grey | Grey | 1 | 410 | A4 + some C |
| 0.15% RE/Sr | 0.01 | Grey | Grey | Grey | Grey | 410 | A5 + A4 + some D/E |
| 0.1% CALBALLOY | 0.01 | 7 | Grey | Grey | 3 | 300 | A5 + E + D |
| 0.1% FOUNDRISIL | 0.03 | 4 | 2 | Grey | Grey | 175 | D + E + A4 |
| 0.07% RE/Ca | 0.03 | 11 | 5 | Grey | 4 | 175 | A4 + D/E |
| 0.15% RE/Ca | 0.03 | 3 | Grey | Grey | Grey | 300 | A4 + some E |
| 0.07% RE/Sr | 0.03 | 9 | 6 | Grey | 6 | 175 | A4/5 + some D/E |
| 0.15% RE/Sr | 0.03 | 2 | Grey | Grey | 1 | 300 | A4/5 + trace D |
| 0.1% CALBALLOY | 0.03 | 10 | 4 mottle | Grey | 4 | 175 | D + E + some A4 |
| Uninoculated | 0.03 | — | — | — | White + mottle | — | — |
| 0.1% RE/Ca | 0.05 | 9 | 5 | Grey | 6 | 355 | A5 + trace D |
| 0.1% FOUNDRISIL | 0.05 | 10 | 6 | Grey | 7 | 175 | D + some A5 |
| 0.15% FOUNDRISIL | 0.05 | 4 | 1 | Grey | 3 | 670 | A4/5 + trace D |
| 0.1% RE/Sr | 0.05 | 13 | 7 | Grey | 5 | 300 | A5 + D |
| 0.1% CALBALLOY | 0.05 | 5 | 1 | Grey | Grey | 540 | A5/A5 + trace D |
| 0.15% CALBALLOY | 0.05 | 3 | Grey | Grey | Grey | 670 | A5 + trace D |
| Uninoculated | 0.05 | — | — | — | White + mottle | — | — |

The significance of the letters and numerals in the column headed "Graphite Morphology" in Table 1 is as follows:

A—The iron contains a random distribution of flakes of graphite of uniform size. This type of graphite structure forms when a high degree of nucleation exists in the liquid iron, promoting solidification close to the equilibrium. graphite eutectic. This is the preferred structure for engineering applications.

C—This type of structure occurs in hypereutectic irons, where the first graphite to form is primary kish graphite. Such a structure may reduce tensile properties and cause pitting on machined surfaces.

D & E—The iron contains fine, undercooled graphites which form in rapidly cooled irons having insufficient graphite nuclei. Although the fine flakes increase the strength of the eutectic, this morphology is undesirable because it prevents the formation of a fully pearlitic matrix.

4—Particle dimensions 12 to 25 mm observed at ×100 magnification, corresponding to true dimensions of 0.12 to 0.25 mm.

5—Particle dimensions 6 to 12 mm observed at ×100 magnification, corresponding to true dimensions of 0.06 to 0.12 mm.

At 0.01% sulphur, the inoculant composition of the invention (RE/Sr), is more effective than the two proprietary inoculants, FOUNDRISIL® and CALBALLOY™, both of which contain approximately 1% of calcium and 1% barium, even at a lower addition rate, and a low eutectic cell count is maintained for the level of inoculation.

At 0.03% sulphur, the RE/Sr composition is still effective but the RE/Ca composition is similar in performance.

At 0.05% sulphur, (which is above the recognised limit for low sulphur irons) the proprietary barium-containing inoculants show equivalent or better chili removal compared with the RE/Sr composition and the RE/Ca composition is also better.

Overall, the results indicate that the RE/Sr composition is a particularly good inoculant for low sulphur irons.

EXAMPLE 2

An inoculant composition was produced as a ferrosilicon based alloy having the following composition by weight.

| | |
|---|---|
| Rare earth | 1.80% |
| (Cerium | 1.0%) |
| Strontium | 0.74% |
| Calcium | 0.07% |
| Aluminium | 0.39% |
| Silicon | 73.00% |
| Iron | balance |

220 g of the inoculant composition were used to treat 170 kg of molten iron containing 3.20% carbon, 1.88% silicon and 0.025% sulphur. Chill wedge test castings were then poured at 1430° C. 1 minute, 3.5 minutes and 7 minutes after inoculation. The depth of chill values measured on the castings were 5 mm, 5 mm and 4 mm respectively.

All the three castings showed type A4 and A5 graphite morphology which is desirable.

EXAMPLE 3

The effect of an inoculation treatment on grey iron decreases with time and this decrease is known as fading.

A series of tests was carried out to assess the performance in terms of fading of various inoculant compositions.

The compositions tested were:

1. The inoculant composition according to the invention used in Example 1.
2. FOUNDRISIL®
3. INOCULIN 25®
   a ferrosilicon based proprietary inoculant containing manganese, zirconium and aluminum.
4. SUPERSEED®
   a ferrosilicon based proprietary inoculant containing nominally 1% strontium and no rare earth.
5. The rare earth/calcium-containing ferrosilicon used in Example 1.

In each test, 170 kg of iron containing 0.03% by weight sulphur was melted in an electric induction furnace and superheated to 1540° C. The iron was trapped into a preheated ladle and immediately returned to the furnace, a 0.2% by weight inoculant addition being made at this point. The furnace temperature was held constant and samples of the inoculated iron were taken at regular intervals and cast into chill wedge moulds. The induction stirring of the iron during the holding period is destructive to nuclei in the iron and thus, produced a severe test of the relative performance of the inoculants.

The cast chili wedges were sectioned and the width of chill was measured. The results obtained are tabulated in Table 2 below.

TABLE 2

| | CHILL (MM) INOCULANT | | | | |
|---|---|---|---|---|---|
| | RE/Sr | FOUNDRISIL | INOCULIN 25 | SUPERSEED | RE/Ca |
| | TIME AFTER INOCULATION MINUTES UNINOCULATION | | | | |
| | W + M | W + M | W + M | W + M | W + M |
| 1 | 7 | 7 | 7 | 8 | 6 |
| 3 | 8 | 10 | 7 | 11 | 7 |
| 5 | 9 | 11 | 7 | 12 + M | 7 |
| 7 | 9 | 12 + M | 10 | | 8 |
| 9 | 11 | | 12 + M | | 9 |
| 11 | 11 | | | | 10 |
| 13 | 11 | | | | 12 + M |
| 15 | 12 + M | | | | |

In Table 2 "W" indicates a white iron structure and "M" indicates mottle. The results show that the inoculant composition according to the invention is superior to the other inoculants in that the rate of fading is lower.

What is claimed is:

1. A composition containing silicon, a rare earth and strontium for inoculating molten grey iron, the composition consisting of by weight:

| | |
|---|---|
| Rare earth | 1.0–4.0% |
| Strontium | 0.5–1.5% |
| Calcium | 1.5% maximum |
| Aluminium | 2.0% maximum |
| Silicon | 40.0–80.0% |
| Iron | balance |

wherein said rare earth is cerium mischmetal containing nominally 50% by weight cerium and 50% by weight other rare earths, or a mixture of cerium and other rare earths.

2. A composition according to claim 1, wherein the composition consisting of by weight.

| | |
|---|---|
| Rare earth | 1.5–2.5% |
| Strontium | 0.7–1.0% |
| Calcium | 0.5% maximum |
| Aluminium | 0.5% maximum |
| Silicon | 70.0–75.0% |
| Iron | balance. |

3. A composition according to claim 1 wherein the composition is free of calcium and aluminum.

4. A composition according to claims 1 wherein the composition is made from a particulate mixture of ferrosilicon and the other constituents of the composition.

5. A composition according to any one of claims 1 wherein the composition is made from a ferrosilicon alloy containing the other constituents.

6. A composition according to claim 1 wherein the composition is made from the rare earth and a silicon-bearing inoculant containing strontium.

7. A composition containing silicon, a rare earth and strontium for inoculating low sulphur molten grey iron, the composition comprising by weight:

| | |
|---|---|
| Rare earth | 1.0–4.0% |
| Strontium | 0.5–1.5% |
| Silicon | 40.0–80.0% |
| Iron | balance |

wherein said rare earth is cerium, mischmetal containing nominally 50% by weight cerium and 50% by weight other rare earths, or a mixture of cerium and other rare earths, and the composition is free of calcium and aluminum except for residual impurities.

8. A composition according to claim 7, the composition comprising by weight:

| | |
|---|---|
| Rare earth | 1.5–2.5% |
| Strontium | 0.7–1.0% |
| Silicon | 70.0–75.0% |
| Iron | balance. |

9. A composition according to claim 7 wherein the composition is made from a particulate mixture of ferrosilicon and the other constituents of the composition.

10. A composition according to claim 7 wherein the composition is made from a ferrosilicon alloy containing the other constituents.

11. A composition according to claim 7 wherein the composition is made from the rare earth and a silicon-bearing inoculant containing strontium.

12. A method for inoculating a low sulphur molten grey iron comprising:

treating a molten low sulphur grey iron wherein said grey iron has a sulphur content of 0.04% or below with inoculant comprising by weight:

| | |
|---|---|
| Rare earth | 1.0–4.0% |
| Strontium | 0.5–1.5% |
| Calcium | 1.5% maximum |
| Aluminium | 2.0% maximum |
| Silicon | 40.0–80.0% |
| Iron | balance |

so as to inoculate said grey iron.

13. The method according to claim 12, the composition comprising by weight:

| | |
|---|---|
| Rare earth | 1.5–2.5% |
| Strontium | 0.7–1.0% |
| Calcium | 0.5% maximum |
| Aluminium | 0.5% maximum |
| Silicon | 70.0–75.0% |
| Iron | balance. |

14. The method according to claim 12 wherein the composition is free of calcium and aluminum.

15. The method according to claim 12 wherein the rare earth is cerium, mischmetal or a mixture of cerium and other rare earths.

16. The method according to claim 12 wherein the composition is made from a particulate mixture of ferrosilicon and the other constituents of the composition.

17. The method according to claim 12 wherein the composition is made from a ferrosilicon alloy containing the other constituents.

18. The method according to claim 12 wherein the composition is made from the rare earth and a silicon-bearing inoculant containing strontium.

* * * * *